US009259033B1

(12) United States Patent
Livingstone

(10) Patent No.: US 9,259,033 B1
(45) Date of Patent: Feb. 16, 2016

(54) CIGARETTE SNUFFING, CUTTING AND STORAGE DEVICE

(76) Inventor: Robert A. Livingstone, South Hempstead, NY (US)

( * ) Notice: Subject to any disclaimer, the term of this patent is extended or adjusted under 35 U.S.C. 154(b) by 855 days.

(21) Appl. No.: 13/551,829

(22) Filed: Jul. 18, 2012

(51) Int. Cl.

| | |
|---|---|
| ***A24D 1/12*** | (2006.01) |
| ***A24F 13/16*** | (2006.01) |
| ***A24F 13/20*** | (2006.01) |
| ***A24F 13/00*** | (2006.01) |
| ***A24F 13/18*** | (2006.01) |

(52) U.S. Cl.
CPC ..... *A24F 13/00* (2013.01); *A24F 13/18* (2013.01); *A24F 13/20* (2013.01)

(58) Field of Classification Search
USPC ..... 131/231, 235.1, 239, 240.1, 242, 242.5, 131/248, 250, 251, 256
See application file for complete search history.

(56) References Cited

U.S. PATENT DOCUMENTS

| | | | | | |
|---|---|---|---|---|---|
| 2,120,027 | A | * | 6/1938 | Johnson | 131/256 |
| 2,371,445 | A | * | 3/1945 | Irvin | 131/256 |
| 2,715,961 | A | * | 8/1955 | Field | 131/256 |
| RE29,001 | E | * | 10/1976 | Foote | 131/256 |
| 4,907,604 | A | * | 3/1990 | Beloff | 131/256 |
| 5,345,953 | A | * | 9/1994 | Taylor | 131/256 |
| 5,377,826 | A | | 1/1995 | Ayres et al. | |
| 5,385,157 | A | | 1/1995 | Smith et al. | |
| 5,862,809 | A | * | 1/1999 | Nicotra | 131/256 |
| 5,947,280 | A | | 9/1999 | Jimenez | |
| 6,161,550 | A | * | 12/2000 | Kontos | 131/250 |
| 6,386,204 | B1 | * | 5/2002 | Kontos | 131/250 |
| 6,431,177 | B1 | * | 8/2002 | Sieggen et al. | 131/256 |
| D468,860 | S | * | 1/2003 | Franzblau | D27/193 |
| D469,571 | S | * | 1/2003 | Franzblau | D27/193 |
| D469,572 | S | * | 1/2003 | Franzblau | D27/193 |
| 6,705,326 | B2 | * | 3/2004 | Rosler | 131/250 |
| D522,689 | S | * | 6/2006 | Bores et al. | D27/136 |
| 7,409,955 | B2 | | 8/2008 | Mauldin et al. | |
| 2003/0172943 | A1 | * | 9/2003 | Connolly | 131/250 |
| 2006/0185683 | A1 | * | 8/2006 | Rigert | 131/237 |
| 2012/0111745 | A1 | * | 5/2012 | Stephenson | 206/242 |

* cited by examiner

*Primary Examiner* — Sing P Chan

(57) ABSTRACT

A cigarette snuffing, cutting and storage system for extending the life of a cigarette through multiple smoking events has a generally cylindrical storage receptacle with a storage tube with a storage lid. The storage lid is pivotally connected to a storage tube top and rotates about an axis located on and in line with a storage tube side wall. A storage lid bottom has an annular cutting blade for severing a cigarette located, inside. The annular cutting blade has a cutting edge located on an interior edge that has a shape of a circle. For operation, a cigarette is inserted into the storage receptacle from a storage tube bottom. The cigarette extends through a storage component cavity and into a storage lid cavity. Upon rotation of the storage lid, an end is removed from the cigarette using the cutting blade, preparing it for use.

3 Claims, 3 Drawing Sheets

CIGARETTE SNUFFING, CUTTING AND STORAGE DEVICE

BACKGROUND OF THE INVENTION

Cigarettes have been used for many years in various shapes and sizes. Most cigarettes are discarded upon finishing, however sometimes the smoking session can be cut short wasting a useable portion of the cigarette. The present invention teaches a cigarette snuffing, cutting and storage system for extending the life of a cigarette through multiple smoking events.

SUMMARY

The present invention features a cigarette snuffing, cutting and storage system for extending the life of a cigarette through multiple smoking events. In some embodiments, the system comprises a generally cylindrical storage receptacle having a storage tube with a storage lid. In some embodiments, the storage lid is pivotally connected to a storage tube top. In some embodiments, the storage lid pivots and rotates about an axis. In some embodiments, the axis is located on and in line with a storage tube side wall.

In some embodiments, a storage lid bottom comprises an annular cutting blade for severing a cigarette located inside. In some embodiments, the annular cutting blade comprises a cutting edge located on an interior edge. In some embodiments, the cutting blade comprises a shape of a circle. In some embodiments, for operation, a cigarette is inserted into the storage receptacle from a storage tube bottom. In some embodiments, the cigarette extends through a storage component cavity and into a storage lid cavity. In some embodiments, upon rotation of the storage lid, an end is removed from the cigarette using the cutting blade, preparing it for use.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
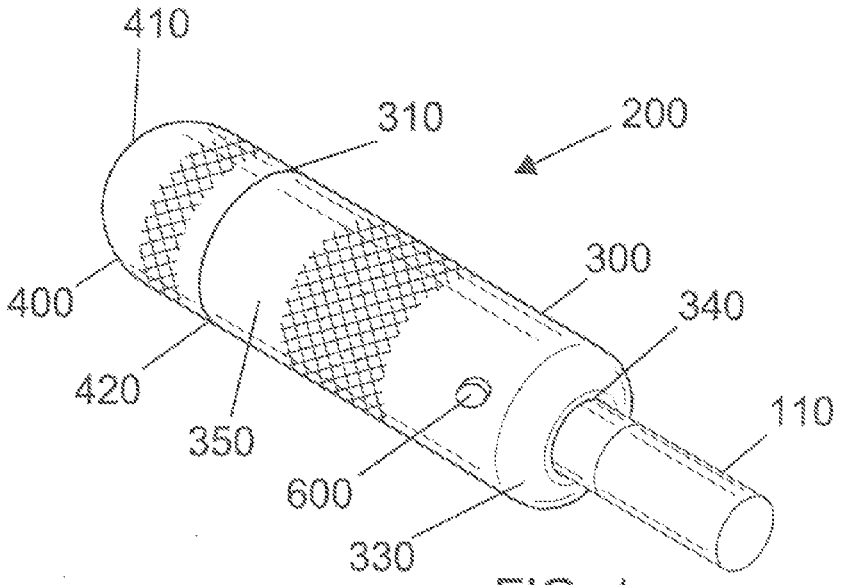
FIG. 1 is a perspective view of the present invention.

Following is a list of elements corresponding to a particular-element referred to herein:

100 Cigarette snuffing, cutting and storage system.
110 Cigarette
200 Storage receptacle
300 Storage tube
310 Storage tube top
320 Storage tube top aperture
330 Storage tube bottom
340 Storage tube bottom aperture
350 Storage tube side wall

Figure 2:
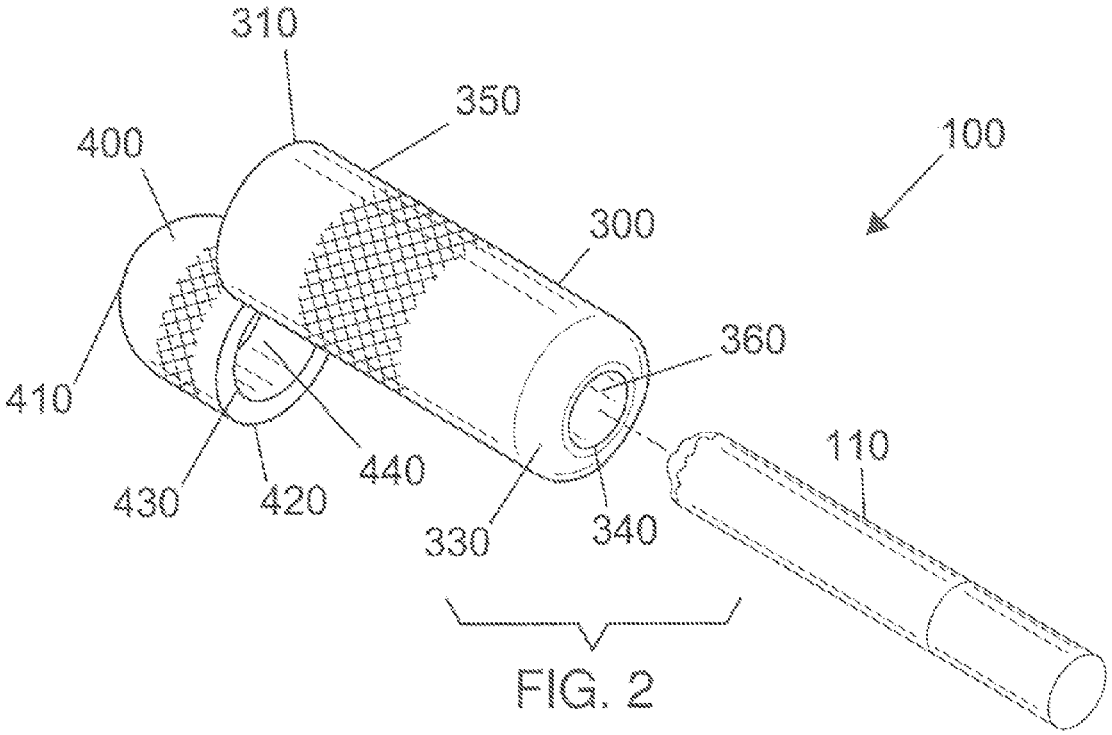
FIG. 2 is a perspective view of the present invention.
Figure 3:
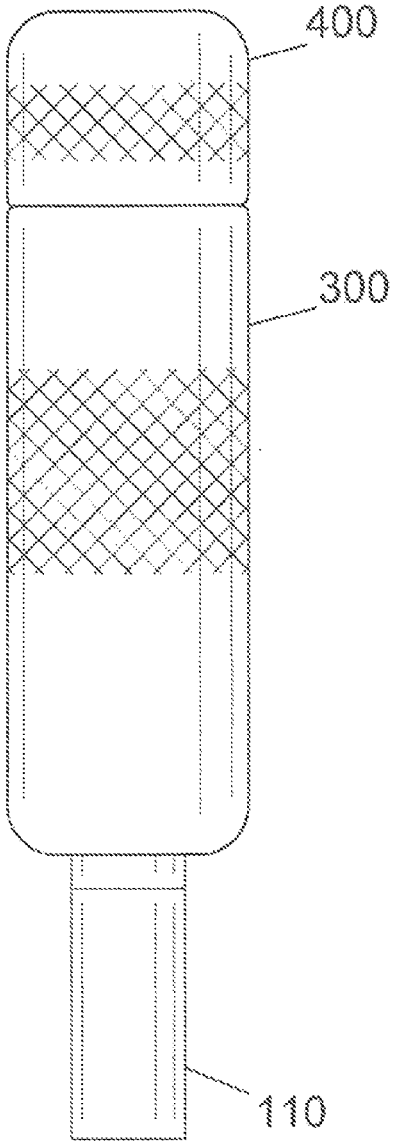
FIG. 3 is a side view of the present invention.
Figure 4:
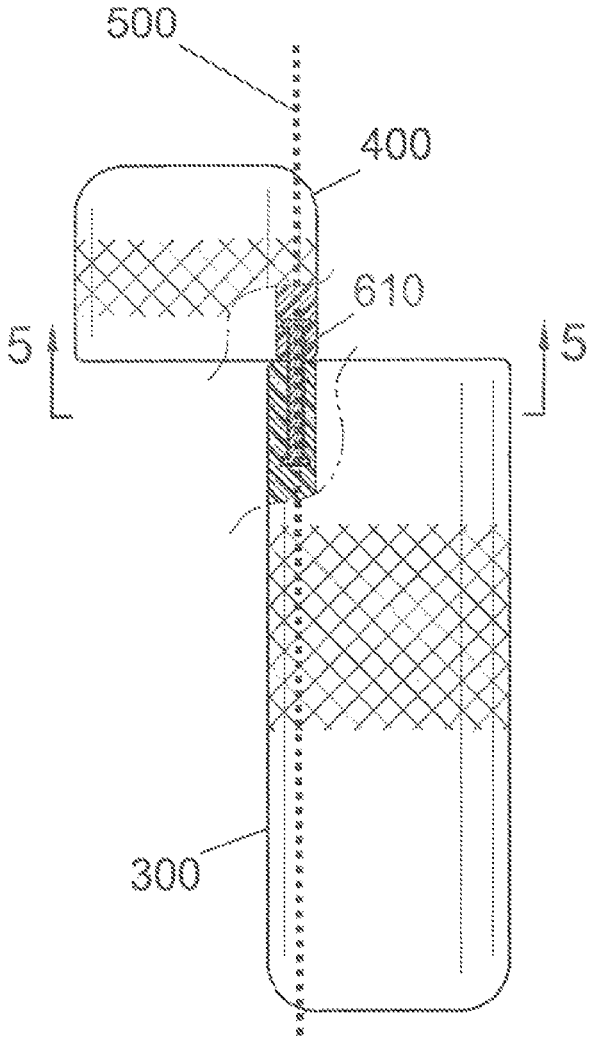
FIG. 4 is a side view of the present invention.
Figure 5:
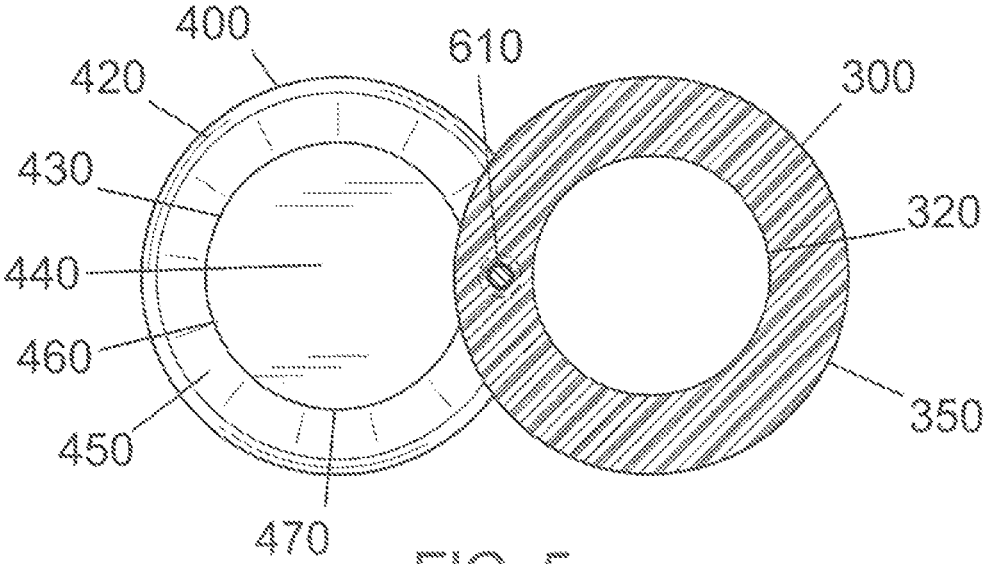
FIG. 5 is a cross-sectional view in a transverse plane of the present invention.

360 Storage tube cavity
400 Storage lid
410 Storage lid top
420 Storage lid bottom
430 Storage lid bottom aperture
440 Storage lid cavity
450 Cutting blade
460 Cutting blade cutting edge
470 Cutting blade interior edge
500 Axis A
600 Compressing member
610 Hinge Referring now to FIG. 1-5, the present invention features a cigarette snuffing, cutting and storage system (100) for extending the life of a cigarette (110) through multiple smoking events. In some embodiments, the system (100) comprises a generally cylindrical storage receptacle (200) having a storage tube (300) with a storage lid (400) located thereon.

In some embodiments, the storage tube (300) comprises a storage tube top (310) having a storage tube top aperture (320) located thereon, a storage tube bottom (330) having a storage tube bottom aperture (340) located thereon, a storage tube side wall (350), and a storage tube cavity (360) located therein fluidly connected to the storage tube top aperture (320) and the storage tube bottom aperture (340).

In some embodiments, the storage lid (400) comprises a storage lid top (410), a storage lid bottom (420) having a storage lid bottom aperture (430) located thereon, and a storage lid cavity (440) fluidly connected to the storage lid bottom aperture (430). In some embodiments, the storage lid bottom (420) is pivotally connected to and faces the storage tube top (310) via a hinge (610). In some embodiments, the storage lid (400) pivots and rotates about an axis, Axis A (500). In some embodiments, Axis A (500) is located on and in line with the storage tube side wall (350).

In some embodiments, the storage lid bottom (420) comprises an annular cutting blade located thereon for severing a cigarette (110) located therein. In some embodiments, the annular cutting blade (450) comprises a cutting blade cutting edge (460) located on an annular cutting blade interior edge (470). In some embodiments, the cutting blade (450) comprises a shape of a circle.

In some embodiments, for operation, a cigarette (110) is inserted into the storage receptacle (200) via the storage tube bottom (330) for snuffing and storing. In some embodiments, the cigarette (110) extends through the storage tube cavity (360) and into the storage lid cavity (440).

In some embodiments, upon rotation of the storage lid (400), an end is removed from the cigarette (110) via the cutting blade (450) preparing it for use. In some embodiments, a cigarette snuffing, cutting and storage system (100) is for extending the life of a cigarette (110) through multiple smoking events.

In some embodiments, the cutting blade (450) is removable and replaceable.

In some embodiments, a compressing member (600) is located in the storage tube side wall (350) for holding a cigarette (110) in place. In some embodiments, the compressing member (600) resembles a spring loaded pin that clamps the cigarette (110) into place.

As used herein, the term "about" refers to plus or minus 10% of the referenced number. For example, an embodiment wherein the device is about 10 inches in length includes a device that is between 9 and 11 inches in length.

The disclosures of the following U.S. Patents are incorporated in their entirety by reference herein: U.S. Pat. No. D 522,689; U.S. Pat. No. 7,409,955; U.S. Pat. No. 6,431,177; U.S. Pat. No. 5,947,280; U.S. Pat. No. 5,385,157; U.S. Pat. No. 5,377,826.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A cigarette snuffing, cutting and storage system (100) for extending the life of a cigarette (110) through multiple smoking events, wherein said system (100) comprises:

a cylindrical storage receptacle (200);

a storage tube (300) with a storage lid (400) disposed on the cylindrical storage receptacle (200);

a storage tube top (310) disposed on the storage tube (300);

a storage tube top aperture (320) disposed on the storage tube top (310);

a storage tube bottom (330) disposed on the storage tube (300);

a storage tube bottom aperture (340) disposed-on the storage tube bottom (330);

a storage tube side wall (350) disposed on the storage tube (300);

a storage tube cavity (360) disposed on the storage tube side wall (350), wherein the storage tube cavity (360) is fluidly connected to the storage tube top aperture (320) and the storage tube bottom aperture (340);

wherein the storage lid (400) comprises a storage lid top (410), a storage lid bottom (420), a storage lid bottom aperture (430) disposed on the storage lid bottom (420), a storage lid cavity (440) disposed inside the storage lid (400), wherein the storage lid cavity (440) is fluidly connected to the storage lid bottom aperture (430), wherein the storage lid bottom (420) is pivotally connected to and faces the storage tube top (310);

wherein the storage lid (400) pivots and rotates about an Axis A (500), wherein Axis A (500) is disposed on and in line with the storage tube side wall (350);

an annular cutting blade (450) disposed on the storage lid bottom (420) for severing a cigarette (110) disposed in the storage lid bottom (420), wherein the annular cutting blade (450) comprises a cutting blade cutting edge (460) disposed on an annular cutting blade interior edge (470), wherein the cutting blade (450) comprises a shape of a circle, wherein a cigarette (110) is inserted into the storage receptacle (200) via the storage tube bottom (330) for snuffing and storing, wherein the cigarette (110) extends through the storage tube cavity (360) and into the storage lid cavity (440), wherein upon rotation of the storage lid (400), an end is removed from the cigarette (110) via the cutting blade (450) preparing it for use, wherein a cigarette snuffing, cutting and storage system (100) is for extending the life of a cigarette (110) through multiple smoking events.

2. The system (100) of claim 1, wherein the cutting blade (450) is removable and replaceable.

3. The system (100) of claim 1, wherein a compressing member (600) is disposed in the storage tube side wall (350) for holding a cigarette (110) in place.

* * * * *